US009320975B2

(12) United States Patent
McClintock et al.

(10) Patent No.: US 9,320,975 B2
(45) Date of Patent: Apr. 26, 2016

(54) SOOTHING DEVICE WITH REMOVABLY ATTACHED TOY

(71) Applicant: KIDS II, INC., Atlanta, GA (US)

(72) Inventors: Christopher McClintock, Watkinsville, GA (US); Brittany Elson, Atlanta, GA (US); Bradford Reese, Decatur, GA (US)

(73) Assignee: KIDS II, INC., Atlanta, GA (US)

( * ) Notice: Subject to any disclaimer, the term of this patent is extended or adjusted under 35 U.S.C. 154(b) by 5 days.

(21) Appl. No.: 14/173,933

(22) Filed: Feb. 6, 2014

(65) Prior Publication Data

US 2014/0220852 A1 Aug. 7, 2014

Related U.S. Application Data

(60) Provisional application No. 61/763,680, filed on Feb. 12, 2013, provisional application No. 61/761,277, filed on Feb. 6, 2013.

(51) Int. Cl.
*A63H 3/00* (2006.01)

(52) U.S. Cl.
CPC ..... *A63H 3/003* (2013.01)

(58) Field of Classification Search
CPC ..... A63H 3/003
USPC ..... 446/73
See application file for complete search history.

(56) References Cited

U.S. PATENT DOCUMENTS

| | | | | |
|---|---|---|---|---|
| 1,279,615 | A | 9/1918 | Van Meter | |
| 3,392,729 | A * | 7/1968 | Lenoir | 606/234 |
| 4,188,747 | A * | 2/1980 | Kramer | 446/73 |
| 4,204,362 | A | 5/1980 | Fournier | |
| 4,277,910 | A * | 7/1981 | Kramer | 446/73 |
| D278,920 | S * | 5/1985 | Wichman | D21/468 |
| 4,852,569 | A * | 8/1989 | Sanders | 606/234 |
| 4,985,968 | A * | 1/1991 | Hooper | 24/302 |
| 5,344,355 | A * | 9/1994 | Silverstein | 446/72 |
| 5,534,014 | A | 7/1996 | Demeritt et al. | |
| 5,593,336 | A | 1/1997 | Thomas | |
| 5,607,452 | A * | 3/1997 | Michaud | 606/234 |
| 5,660,301 | A * | 8/1997 | Kaplowitz | 220/771 |
| D393,074 | S * | 3/1998 | Fields et al. | D24/194 |
| D409,755 | S | 5/1999 | Thorpe et al. | |

(Continued)

OTHER PUBLICATIONS

Delhaye, Michel, EP 1847307 A1, Oct. 2007.*

*Primary Examiner* — Michael Dennis
*Assistant Examiner* — Dolores Collins
(74) *Attorney, Agent, or Firm* — Gardner Groff Greenwald & Villanueva, PC

(57) ABSTRACT

A combination soother-toy device includes a soothing device such as a pacifier, a toy such as a plush animal character, and a coupling that removably attaches them together. In some embodiments, the coupling includes a transverse tab and a transverse opening that couple and decouple by a transverse motion. In this way, the axial pulling motion and forces that babies often apply to the toy when holding the pacifier in its mouth do not cause the components to separate. In some embodiments, the tab (transverse or not) is retained on the toy by a primary attachment such as stitching and a secondary retainer for redundancy as a safety feature. For example, the secondary retainer can be a tether attaching the tab extension arm to the toy, or wings extending from the tab extension arm laterally beyond the toy opening through which the extension arm extends.

18 Claims, 18 Drawing Sheets

(56) References Cited

U.S. PATENT DOCUMENTS

| | | | | |
|---|---|---|---|---|
| D413,675 | S | 9/1999 | Thorpe et al. | |
| 6,066,162 | A * | 5/2000 | Hudson | 606/234 |
| 6,221,093 | B1 | 4/2001 | Prince | |
| D443,065 | S | 5/2001 | Byes et al. | |
| 6,299,501 | B1 | 10/2001 | Lynch | |
| 6,461,214 | B1 | 10/2002 | Lynch | |
| 6,634,919 | B2 * | 10/2003 | Gordon et al. | 446/73 |
| 6,666,720 | B1 * | 12/2003 | Reisinger et al. | 439/607.13 |
| 6,666,740 | B1 * | 12/2003 | Schneider | 446/72 |
| 6,684,422 | B2 * | 2/2004 | LeFevre et al. | 5/496 |
| 6,810,545 | B1 | 11/2004 | Darling et al. | |
| D500,817 | S | 1/2005 | Forte | |
| D519,581 | S | 4/2006 | Velez et al. | |
| 7,086,121 | B2 * | 8/2006 | Lippincott | 24/3.13 |
| D609,284 | S | 2/2010 | Markland et al. | |
| D625,369 | S | 10/2010 | Raimondi | |
| D633,576 | S | 3/2011 | Dalton et al. | |
| D633,577 | S | 3/2011 | Dalton et al. | |
| D643,074 | S | 8/2011 | Dalton et al. | |
| D650,868 | S | 12/2011 | Dalton et al. | |
| 8,156,616 | B2 * | 4/2012 | Lo | 24/516 |
| 8,636,768 | B2 * | 1/2014 | Rohrig | 606/234 |
| 8,864,547 | B2 * | 10/2014 | Elson et al. | 446/227 |
| D717,454 | S * | 11/2014 | Reese | D24/195 |
| 2002/0187719 | A1 | 12/2002 | Schneider | |
| 2006/0168766 | A1 * | 8/2006 | Lippincott | 24/3.13 |
| 2008/0134432 | A1 * | 6/2008 | Brandon | 5/482 |
| 2008/0215092 | A1 * | 9/2008 | Smith | 606/236 |
| 2009/0030455 | A1 | 1/2009 | Dallman | |
| 2009/0081921 | A1 | 3/2009 | Urueta | |
| 2009/0191783 | A1 | 7/2009 | Spitzer et al. | |
| 2009/0255028 | A1 * | 10/2009 | Weisblatt | 2/80 |
| 2009/0270010 | A1 | 10/2009 | Scott et al. | |
| 2010/0062677 | A1 * | 3/2010 | Savoni et al. | 446/139 |
| 2010/0234887 | A1 | 9/2010 | Smith | |
| 2010/0304636 | A1 * | 12/2010 | Seiz | 446/72 |
| 2010/0317252 | A1 | 12/2010 | Raimondi | |
| 2011/0224730 | A1 | 9/2011 | Holley | |
| 2012/0041487 | A1 * | 2/2012 | Griffis | 606/234 |
| 2012/0049023 | A1 * | 3/2012 | Reese | 248/221.11 |

* cited by examiner

FIG. 52
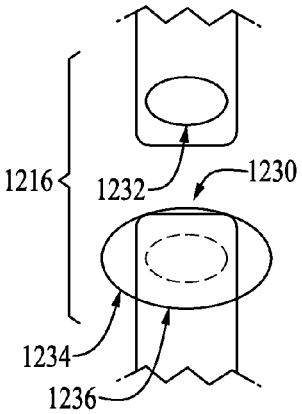
FIG. 53
FIG. 54
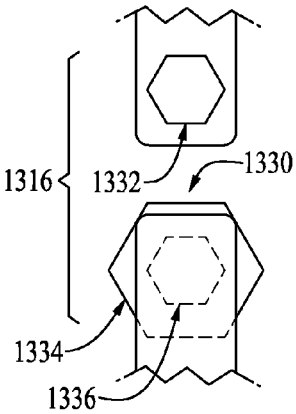
FIG. 55
FIG. 56
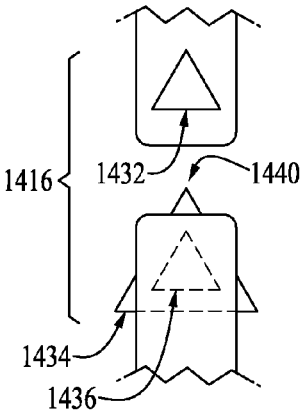
FIG. 57

SOOTHING DEVICE WITH REMOVABLY ATTACHED TOY

CROSS-REFERENCE TO RELATED APPLICATIONS

This application claims the priority benefit of U.S. Provisional Patent Application Ser. No. 61/763,680 filed Feb. 12, 2013, and U.S. Provisional Patent Application Ser. No. 61/761,277 filed Feb. 6, 2013, the entireties of which are hereby incorporated herein by reference for all purposes.

TECHNICAL FIELD

The present invention relates generally to the field of infant oral suckling accessories, and more particularly to soothing devices such as pacifiers and teethers.

BACKGROUND

Infant oral soothing devices are thought to provide comfort to infants by providing them the opportunity to act on oral tendencies such as sucking, chewing, and generally placing things in their mouths. Such soothing devices include pacifiers and teethers, and are additionally thought to actually reduce pain and provide delight, with teethers especially comforting to infants when they are teething. In addition, it is known to combine pacifiers with plush toys intended to provide amusement and/or comfort to infants. Such combined pacifier-toy devices include those disclosed by U.S. Pat. No. 6,666,740 and U.S. Patent Publication No. 2010/0234887.

While such pacifier-toy combinations appear to demonstrate potential benefits, there remain concerns about them. For example, in some combination devices the toy and the pacifier are separable for cleaning and independent use, but too easily so such that the toy and/or pacifier can too easily fall to the ground and become dirty, or such that certain coupling components present a choking hazard. And in some other combination devices the plush toy and the plastic pacifier are not separable, but then they cannot be separately cleaned as needed for proper sanitary conditioning.

Accordingly, it can be seen that needs exist for improvements in combination pacifier-toy devices to provide for ease of cleaning, sanitary use, and safety of use. It is to the provision of solutions meeting these and other needs that the present invention is primarily directed.

SUMMARY

Generally described, the invention relates to a combination soother-toy device that includes a soothing device, a toy, and a coupling that removably attaches them together. The soothing device can be for example a pacifier or alternatively a teether, and the toy can be for example a plush animal character or alternatively a ball or noise-maker. The detachment coupling permits the pacifier and the toy to be separated for independent use and/or cleaning.

In one aspect of the invention, the detachment coupling includes a transverse tab and a transverse opening that couple and decouple by a transverse motion through which the tab transversely inserts into and withdraws from the opening. In this way, the axial pulling motion and forces that babies often apply to the toy when holding the pacifier in its mouth do not cause the components to separate. In one such example embodiment, the tab includes a retaining head at the end of a transverse connecting arm that extends from an axial extension arm attached to the toy, and the opening includes a slot formed in an extension arm that extends axially from the pacifier.

In another aspect of the invention, a coupling element such as the tab (transverse or not) is retained on the toy by a primary attachment such as stitching and a secondary retainer for redundancy as a safety feature. In this way, in the unlikely event that the primary attachment fails, the secondary retainer will prevent the coupling element from separating and presenting a choking hazard. In example embodiments, the secondary retainer is in the form of a tether attaching the tab extension arm to the toy, or wings extending from the tab extension arm laterally beyond the toy opening through which the extension arm extends.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are exemplary and explanatory of typical embodiments of the invention, and are not restrictive of the invention as claimed.

BRIEF DESCRIPTION OF THE DRAWINGS

FIGS. 17-18 show the pacifier and toy of FIG. 3 being decoupled apart.

FIG. 52 is a top view of a pacifier portion of a combination pacifier-toy device according to a thirteenth example embodiment of the invention.

FIG. 53 is a top view of a toy portion of the combination pacifier-toy device of FIG. 52.

FIG. 54 is a top view of a pacifier portion of a combination pacifier-toy device according to a fourteenth example embodiment of the invention.

FIG. 55 is a top view of a toy portion of the combination pacifier-toy device of FIG. 54.

FIG. 56 is a top view of a pacifier portion of a combination pacifier-toy device according to a fifteenth example embodiment of the invention.

FIG. 57 is a top view of a toy portion of the combination pacifier-toy device of FIG. 56.

DETAILED DESCRIPTION OF EXAMPLE EMBODIMENTS

Figure 1:
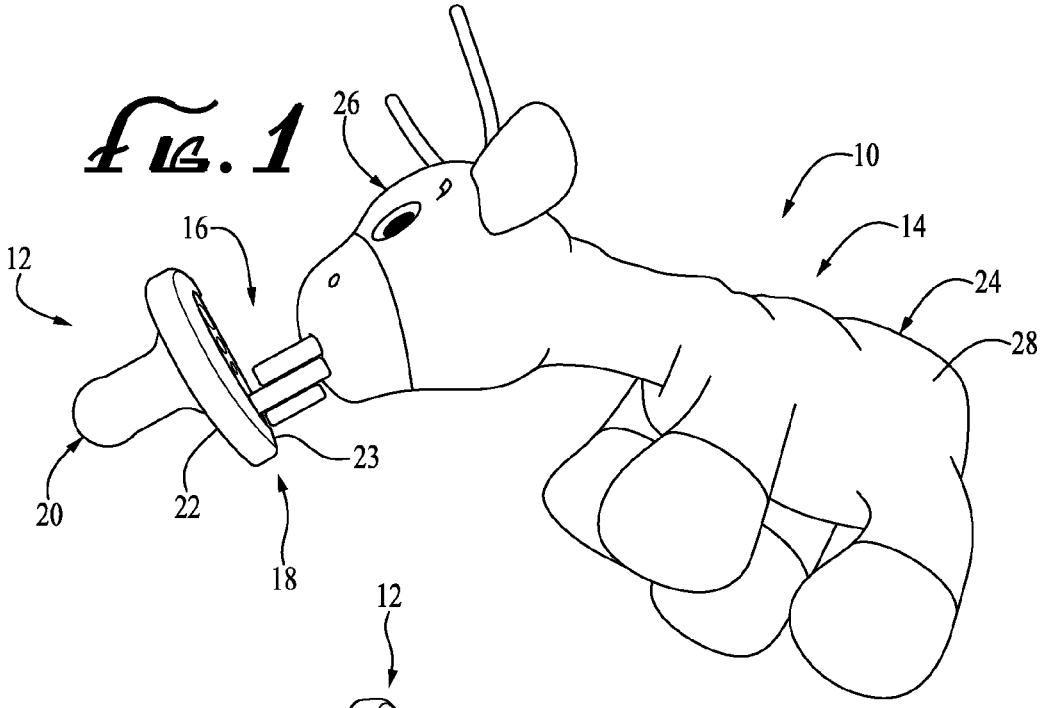
FIG. 1 is a perspective view of a combination pacifier-toy device according to a first example embodiment of the present invention, including a pacifier, a toy, and a coupling detachably connecting them together.
Figure 2:
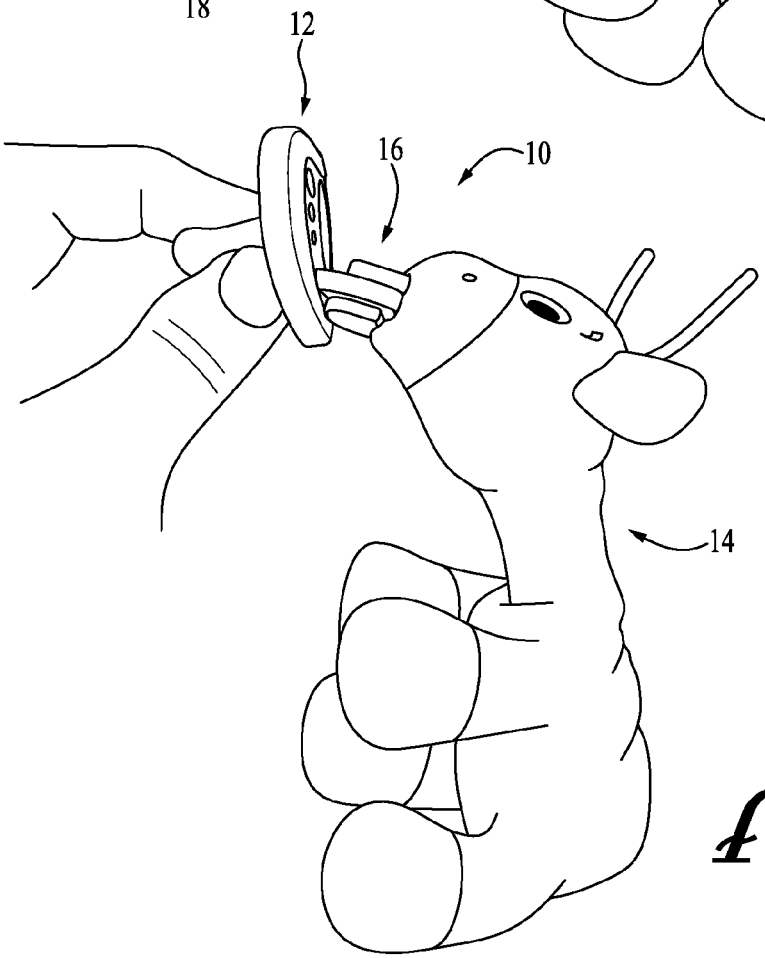
FIG. 2 shows the device of FIG. 1 in a use position with the pacifier being held and the toy suspended therefrom.
Figure 3:
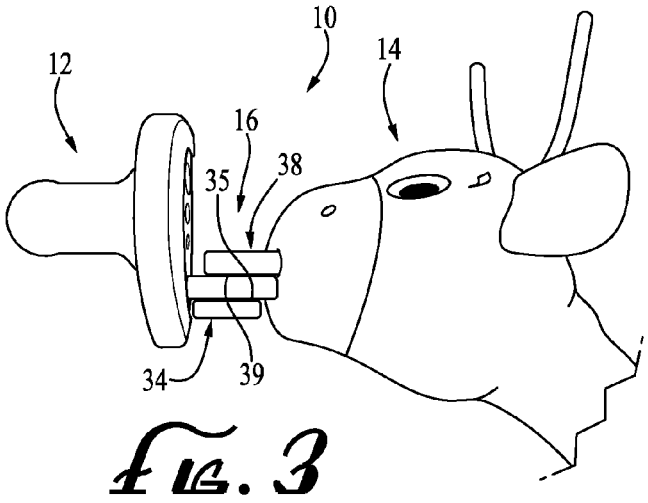
FIG. 3 is a side view of the pacifier, the coupling, and a portion of the toy of FIG. 1.
Figure 4:
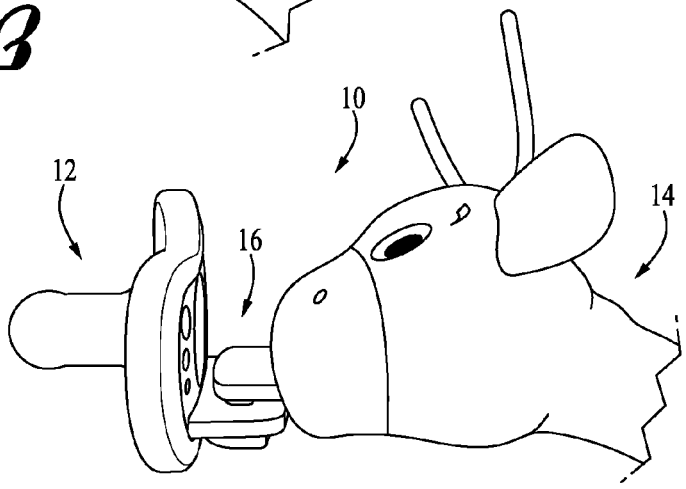
FIG. 4 is a top-side perspective view of the device portions of FIG. 3.
Figure 5:
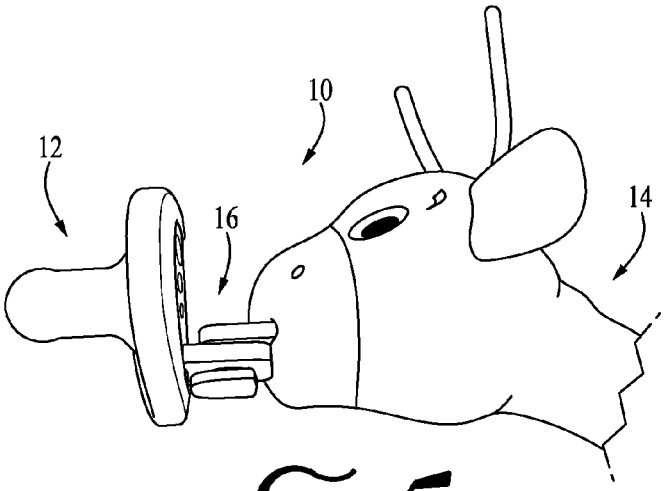
FIG. 5 is a bottom-side perspective view of the device portions of FIG. 3.
Figure 6:
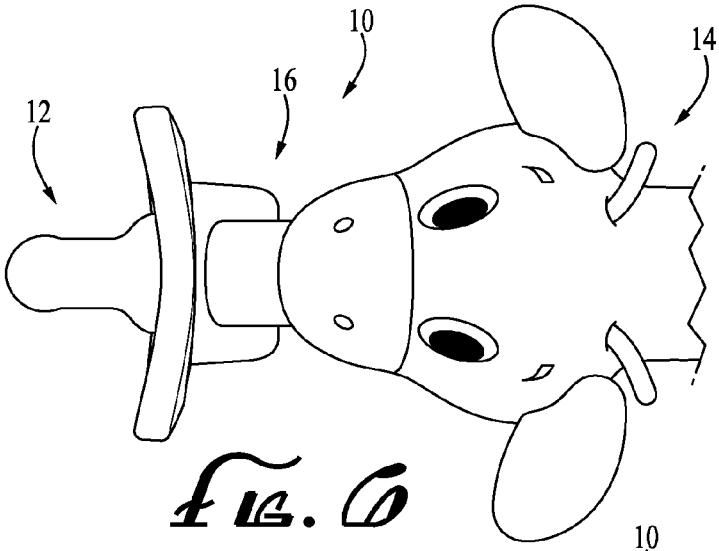
FIG. 6 is a top view of the device portions of FIG. 3.
Figure 7:
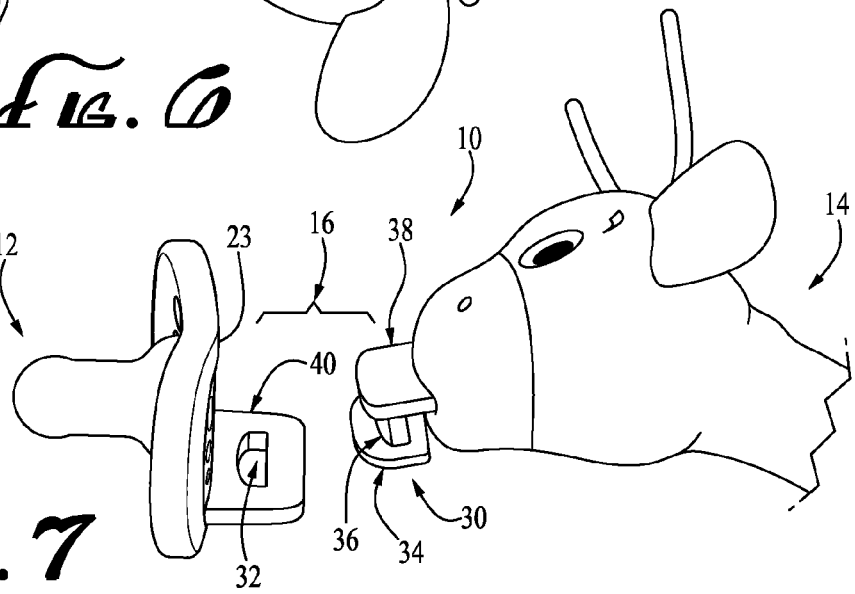
FIG. 7 shows the pacifier and toy of FIG. 4 detached from each other.
Figure 8:
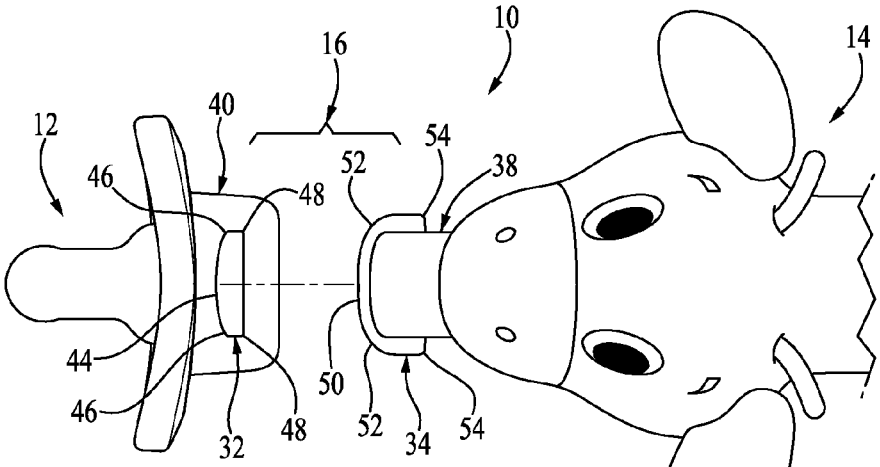
FIG. 8 is a top view of the detached device portions of FIG. 7.
Figure 9:
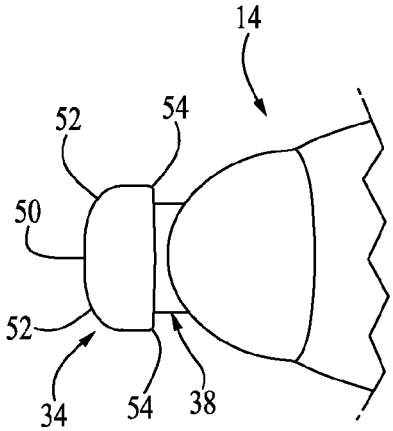
FIG. 9 is a bottom view of the portion of the toy and coupling of FIG. 8.
Figure 10:
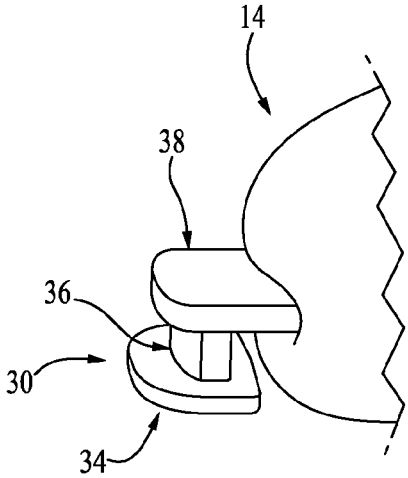
FIG. 10 is a top perspective view of the device portions of FIG. 9.
Figure 11:
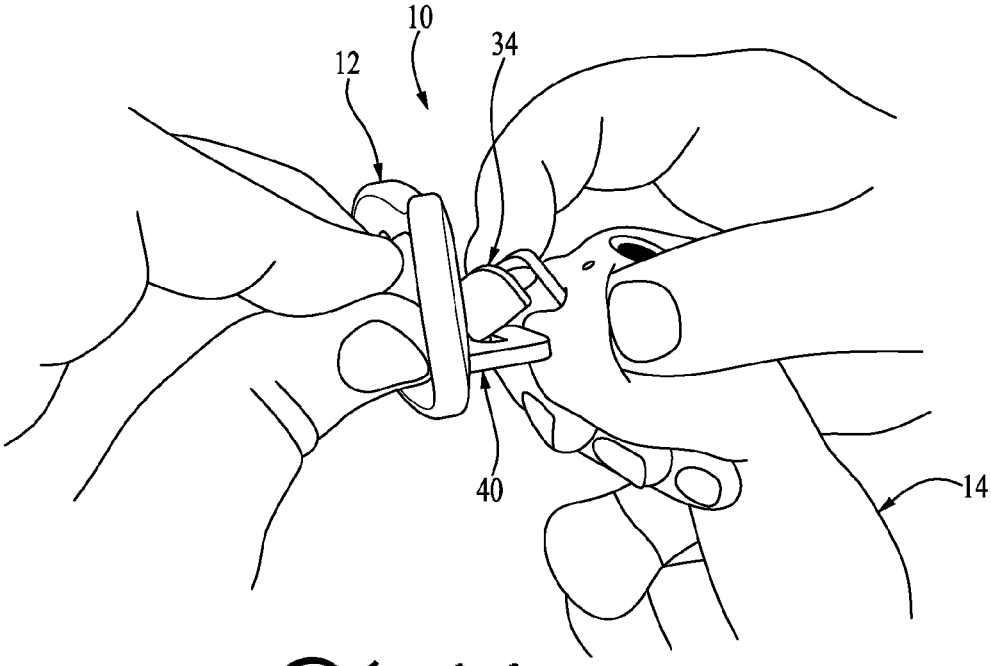
FIG. 11 is a perspective view of the device of FIG. 1 showing a step of a coupling process in which the pacifier and toy are coupled together.
Figure 12:
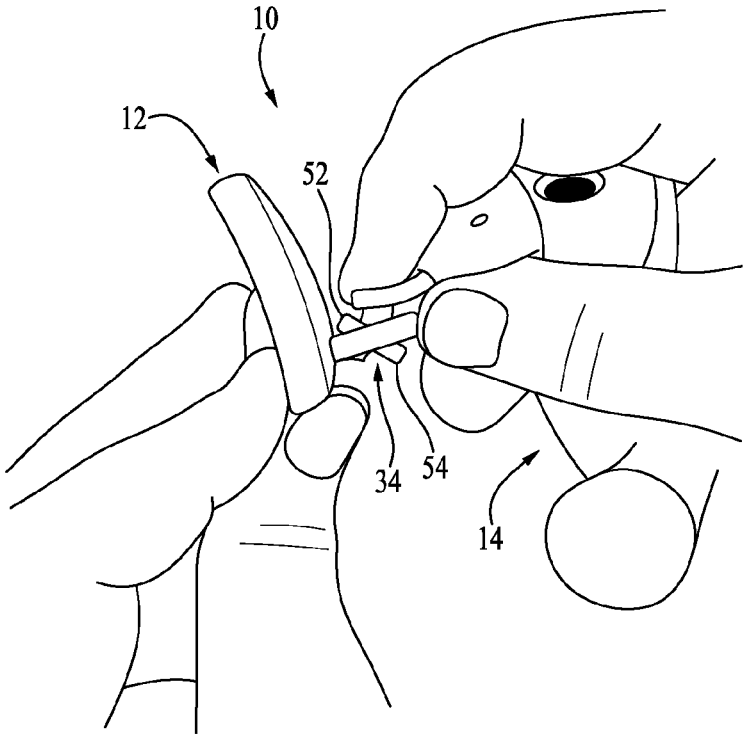
FIG. 12 is a side view of the device of FIG. 11 showing a next step of the coupling process.
Figure 13:
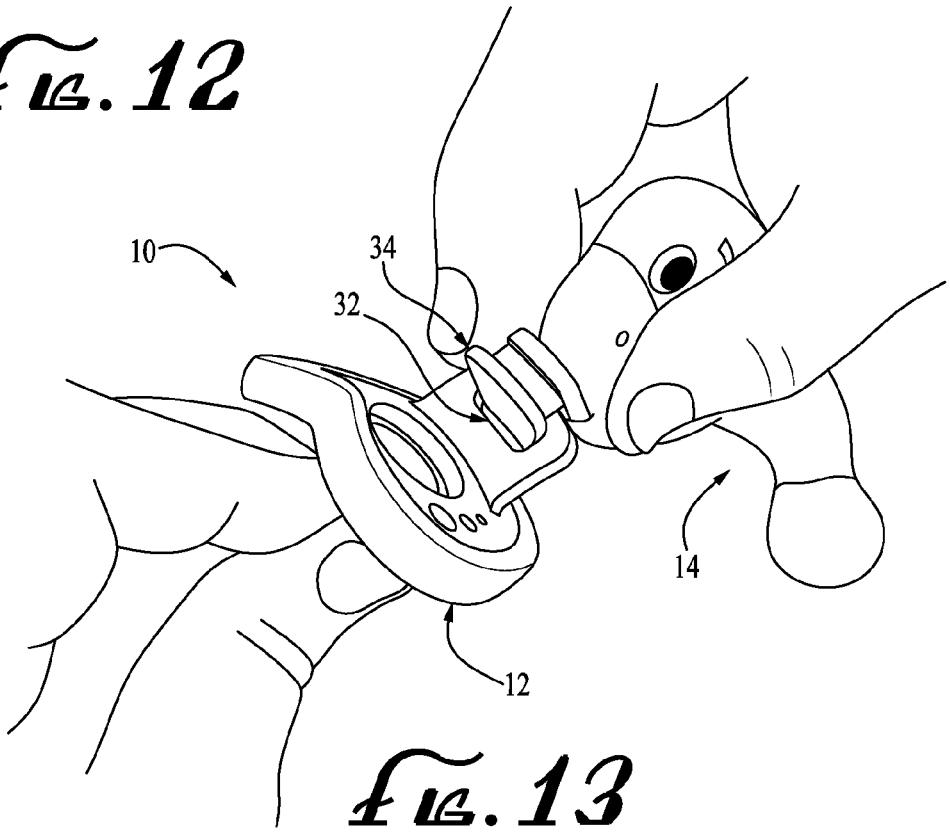
FIG. 13 is a top perspective view of the device of FIG. 12.
Figure 14:
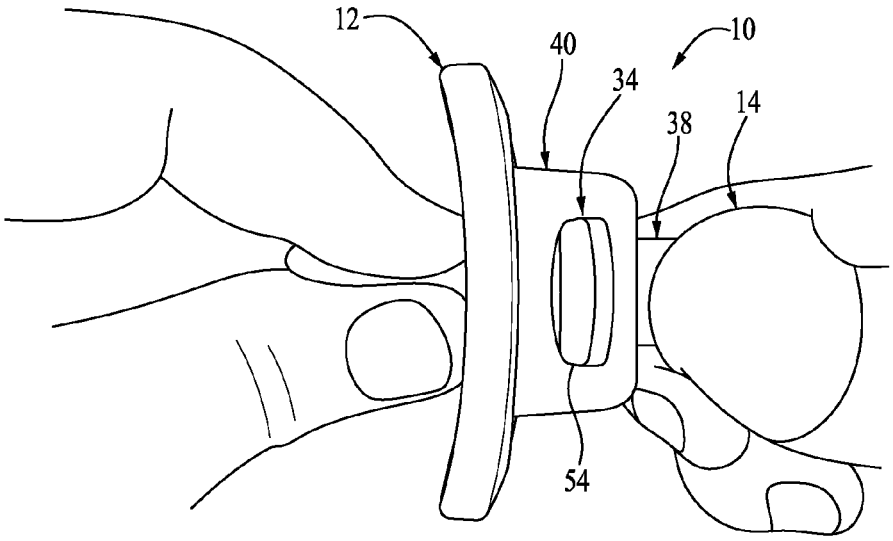
FIG. 14 is a bottom view of the device of FIG. 12.
Figure 15:
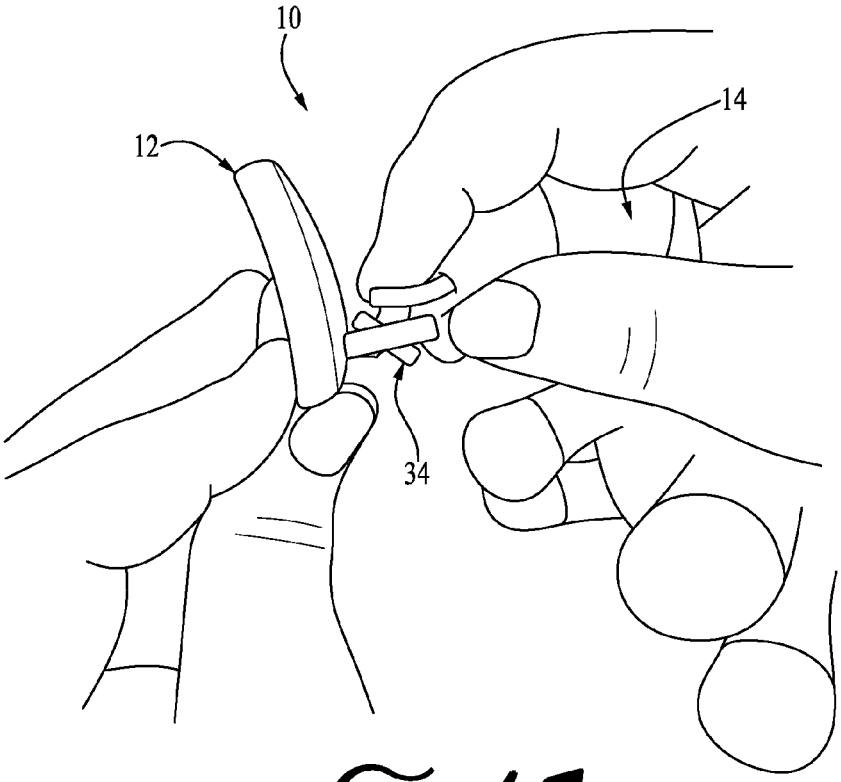
FIG. 15 is a side view of the device of FIG. 12 showing a next step of the coupling process.
Figure 16:
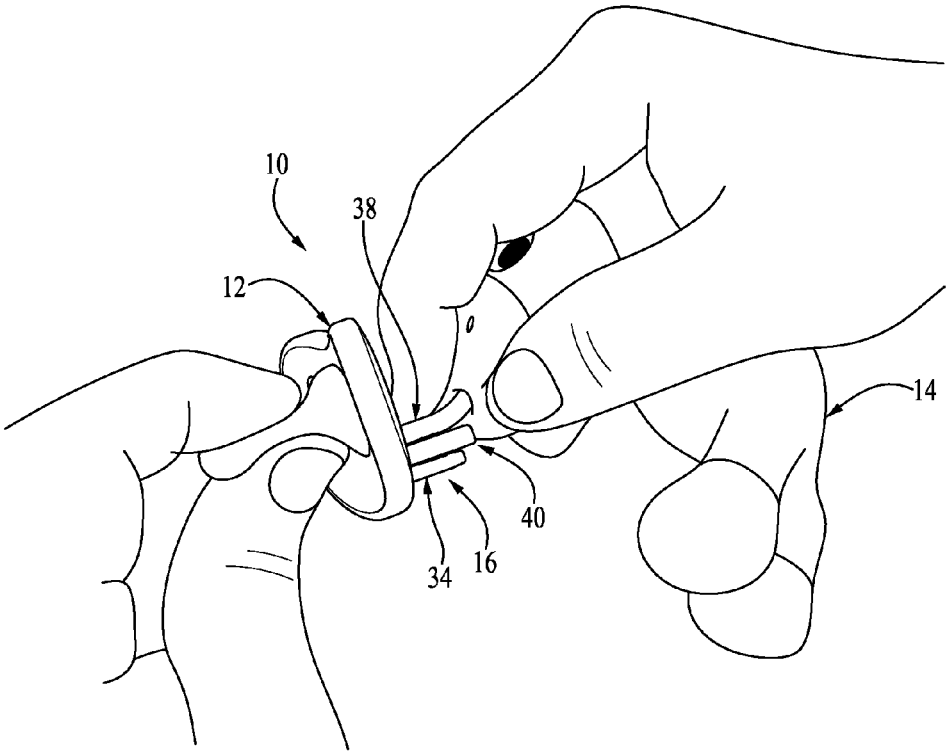
FIG. 16 shows the device of FIG. 15 in the coupled position at the end of the coupling process.
Figure 17:
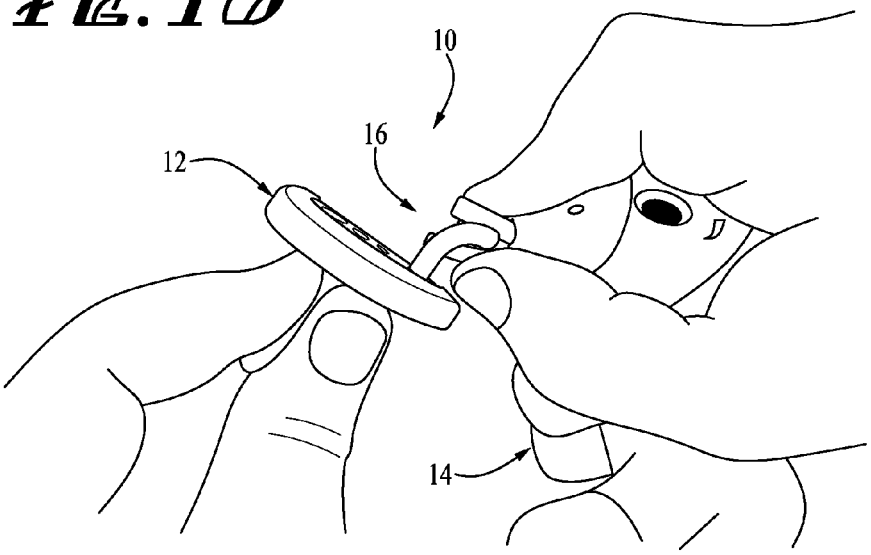
FIG. 17 is a side view of the device of FIG. 15 showing a step of a decoupling process in which the pacifier and toy are separated from each other.
Figure 18:
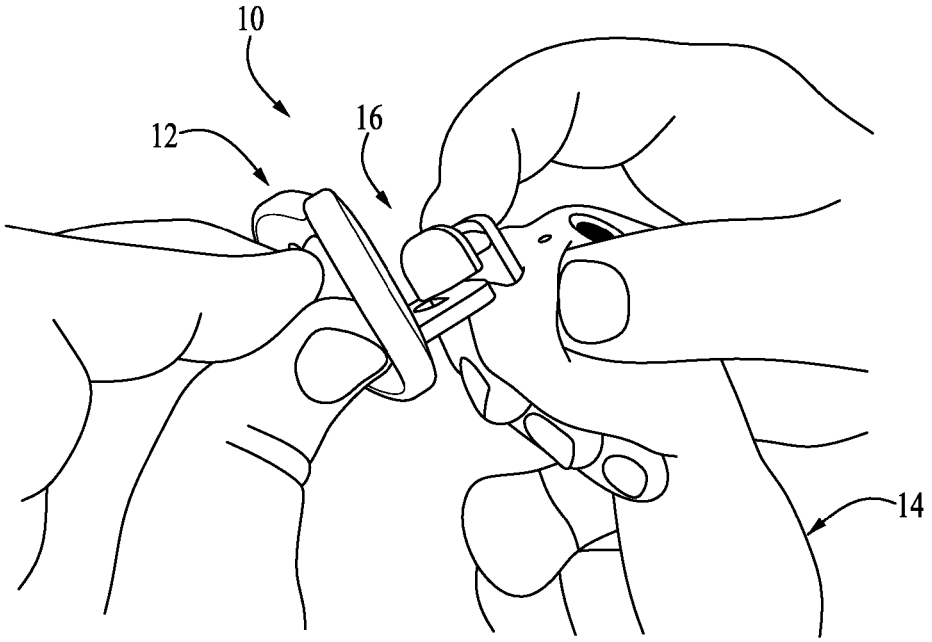
FIG. 18 is a perspective view of the device of FIG. 17 showing the pacifier and toy separated from each other at the end of the decoupling process.
Figure 19:
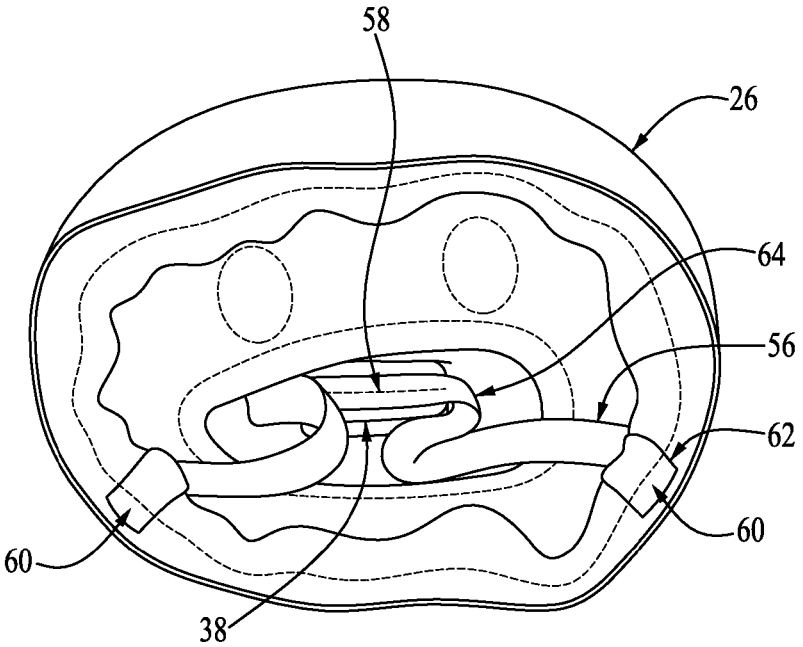
FIG. 19 is a top-rear perspective view of a head portion of the toy of FIG. 1, with a body portion of the toy and with stuffing of the head portion removed to show internal components of the toy.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-22 show a combination soother-toy device 10 according to a first example embodiment of the invention. The soother-toy device 10 includes a soothing device 12, a toy 14, and a coupling 16 that functions to removably attach them together.

In the depicted embodiment, the soothing device 12 is a pacifier. In other embodiments, the soothing device is a teether or other device for providing soothing comfort to a baby. As such, although the invention is described herein with respect to a pacifier, it will be understood that instead other soothing devices can be provided and readily adapted to include the respective coupling portion. The basic design of the pacifier 12 can be of a conventional type, for example, including a flange 18 and a nipple 20 extending from a front side 22 of the flange. The pacifier can be made of conventional materials such as silicone, polypropylene (PP), ethylene vinyl acetate (EVA), acrylonitrile butadiene styrene (ABS), thermo-plastic rubber (TPR), which can be translucent, transparent with color, or opaque, and which can be formed with a durometer of for example about 30 to about 85 Shore A.

In some embodiments, a protective cover is provided for the pacifier 12. The cover can be removable or permanently attached to the pacifier 12. For example, the cover can be permanently attached to the pacifier 12 by a living hinge and repositionable between a covered position for storage and an uncovered position for use.

In the depicted embodiment, the toy 14 is a plush toy such as an animal character (e.g., a cow). In other embodiments, the toy is a ball, a noise-maker, or another toy for providing interest (e.g., amusement, entertainment, and/or education) to a baby. As such, although the invention is described herein with respect to a plush toy, it will be understood that other toys can be provided instead. The basic design of the plush toy 14 can be of a conventional type, for example, including a body 24 and a head 26 extending from the body, with both formed of a shell 28 made of a soft flexible material such polyester and stuffing (not shown) made of a soft flexible material such polyester substantially filling the shell for shape retention.

The detachment coupling 16 includes a transverse tab 30 and a transverse opening 32 that removably receives the transverse tab. In the depicted embodiment, the transverse tab 30 extends from the toy 14 and the transverse opening 32 is formed in the pacifier 12. In other embodiments, these two components are reversed, with the transverse tab extending from the pacifier and the transverse opening formed in the toy. To insert and remove the tab 30 through the opening 32, a motion is required that is transverse to the axis of the pacifier nipple 20 and the toy body 24 (for example, as described herein with respect to FIGS. 11-18). Of course, the toy 14 can be removed from the pacifier 12 by applying only an axial pulling force on the toy body 24 if that force is great enough, because the soft flexible coupling components will elastically deform (and eventually fail), but even in that event the result is typically still a transverse motion (though smaller) of the deformed tab 30 through the deformed opening 32.

This transverse arrangement of the tab 30 and the opening 32 keep the pacifier 12 and the toy 14 coupled together for use and enable easy detachment by a caretaker when desired for cleaning or independent use. Infants tend to pull on the toy body 24 in an axial direction, but do not tend to apply transversely-directed forces to the toy 14. Because transverse motion is required to detach the toy 14 from the pacifier 12, these components are not readily separated by the infant user. But a caregiver can easily transversely separate the toy 14 from the pacifier 12 as desired.

Figure 20:
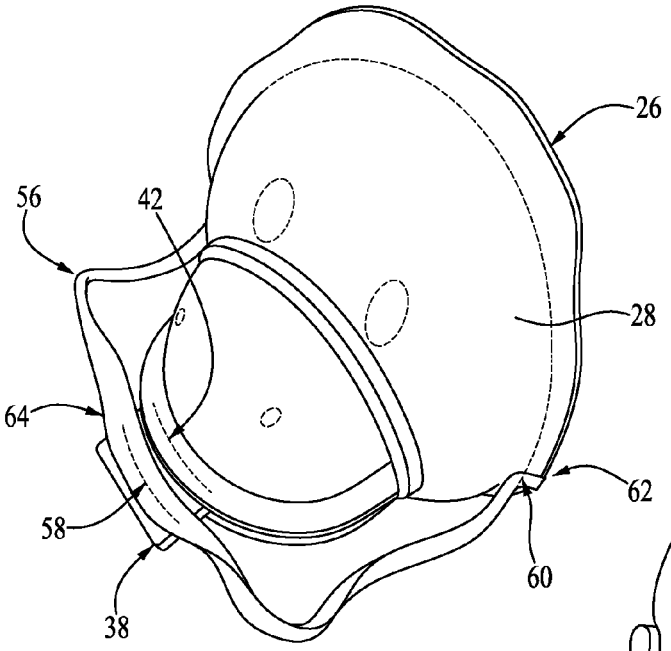
FIG. 20 is a top-side perspective view of the toy head portion of FIG. 19, with the head portion inverted (turned inside-out) to show internal (now external) components of the toy.
Figure 21:
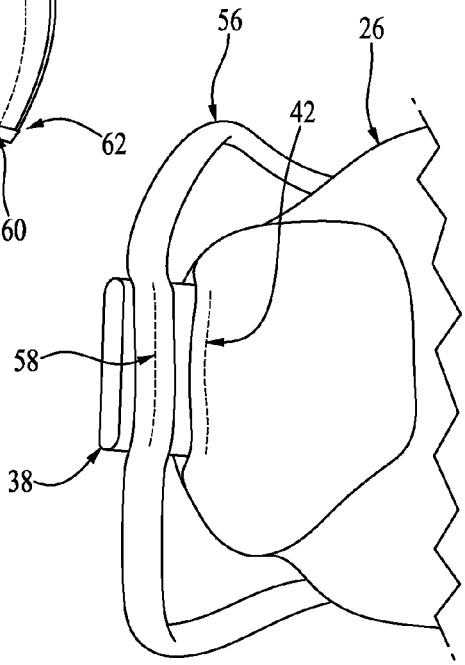
FIG. 21 is a top view of a portion of the toy head portion of FIG. 20.
Figure 22:
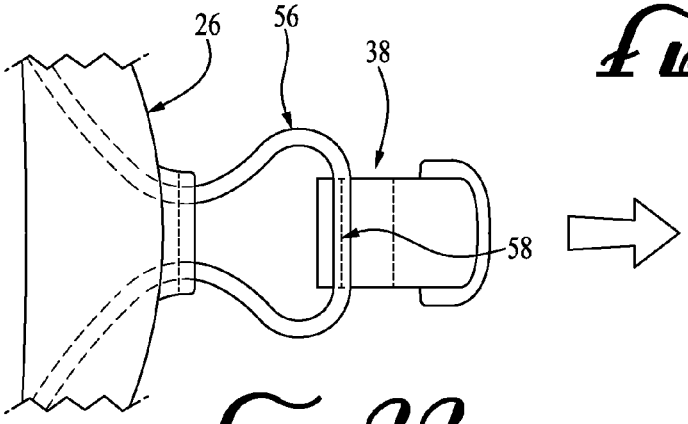
FIG. 22 is a top view of the toy head portion of FIG. 19, with an attachment of a toy coupling portion to the head portion having failed, but a secondary retainer securing them together.
Figure 23:
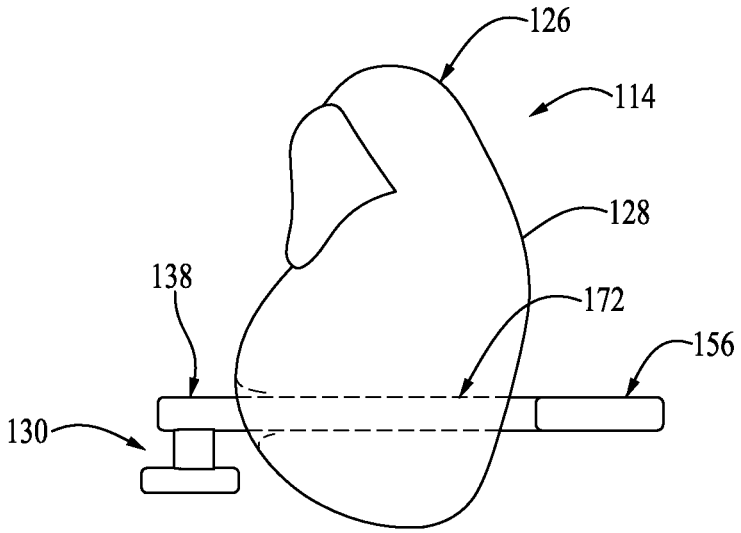
FIG. 23 is a side view of a head portion and a toy coupling portion of a toy of a combination pacifier-toy device according to a second example embodiment of the present invention, with a body portion of the toy and with stuffing of the head portion removed to show internal components of the toy.
Figure 24:
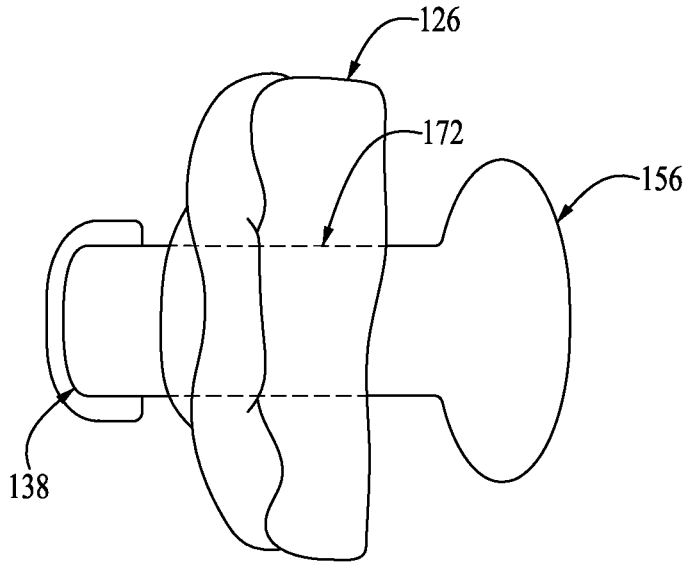
FIG. 24 is a top view of the toy head portion and coupling portion of FIG. 23.
Figure 25:
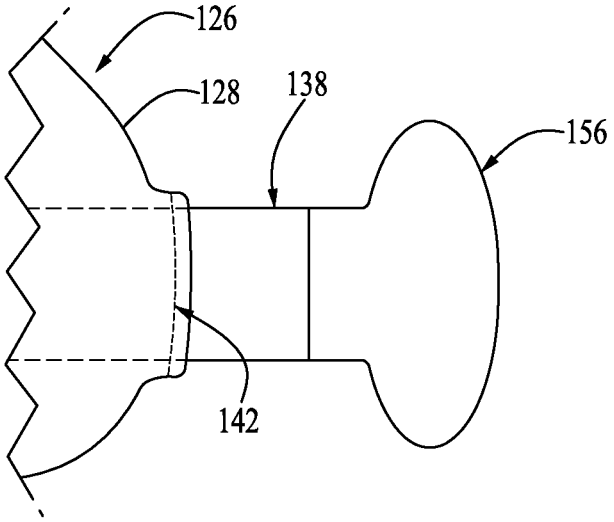
FIG. 25 is a detail view of the device portions of FIG. 24, with the head portion inverted (turned inside-out) to show internal (now external) components of the toy.
Figure 26:
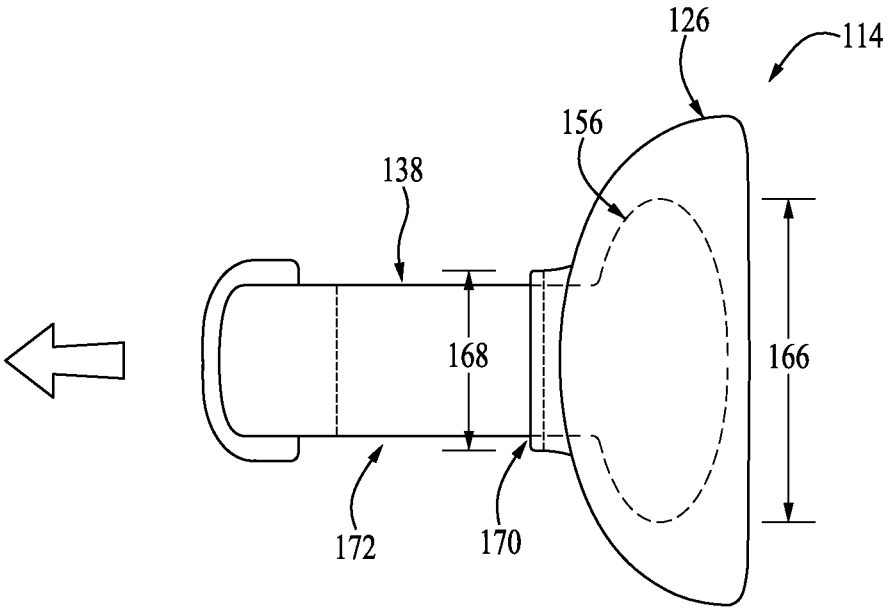
FIG. 26 shows the device portions of FIG. 24, with an attachment of the toy coupling portion to the head portion having failed, but a secondary retainer securing them together.

In the depicted embodiment, the tab 30 includes a transverse connecting arm 36 and a retaining head 34 at or adjacent its end. The connecting arm 36 extends transversely from an extension arm 38 that in turn extends from the toy 14 axially and parallel to the longitudinal axis of the toy body 24. The retaining head 34, the transverse connecting arm 36, and the axial extension arm 38 can all be in the form of generally flat panels or plates (as depicted), or bars, rods, or the like. In addition, the depicted opening 32 is in the form of a slot defined by an extension arm 40 extending from the flange 18 axially and parallel to (e.g., offset from and below) the longitudinal axis of the nipple 20. The tab extension arm 38 can be permanently fixed to the toy 14, for example at a mouth of the toy head 26, by an attachment 42 such as a conventional fastener for example stitching (as depicted in FIGS. 20-21), a button, a snap, an adhesive, or another conventional fastener. And the slot extension arm 40 can be integrally formed with the pacifier 12 as a single piece, for example extending from a back side 23 of the flange 18 in a direction defined by the axis of the nipple 20. In other embodiments, the tab extension arm is an integrally formed part and/or the slot extension arm is permanently attached by conventional fasteners. In typical embodiments such as that depicted, the tab 30 and the slot 30 have a uniform thickness and configuration so that the coupling 16 is reversible, that is, the tab can be inserted through the slot from either side (e.g., from the top or the bottom).

The tab retaining head 34 is sufficiently larger than the slot 32 so that when they are coupled together the retaining head will not pass back through the slot absent a transverse relative motion being generated between the two parts. But the tab retaining head 34 is not so much larger than the slot 32 that the two parts cannot be easily coupled and decoupled by the soft flexible retaining head and slot extension arm 40 deforming to allow the retaining head through upon the transverse relative motion being generated between the two parts.

It should be noted that the transverse tab and opening can be provided in a number of different forms other than those expressly described herein. For example, in some embodiments the transverse tab and/or opening are strictly perpendicular to the nipple axis (as depicted), and in other embodiments they are not (i.e., they extend in a direction having a perpendicular and an axial component). Also, the transverse connecting arm, retaining head, and/or transverse opening can be provided in a number of different shapes, for example round/cylindrical, triangular, elliptical, hexagonal, or another polygonal or other regular or irregular shape. In other embodiments, the retaining head does not circumscribe the transverse connecting arm and instead extends only partially, discontinuously, or intermittently around the periphery of the connecting arm. And in still other embodiments, a series or array of transverse tabs are provided for engaging only one or a series or array of transverse openings. a series or array of transverse tabs are provided for engaging only one or a series or array of transverse openings.

To facilitate the transverse-motion coupling and decoupling of the tab retaining head 34 and the slot 32, these components can be specially designed. In the depicted embodiment (see FIGS. 7-10), for example, the slot 32 is generally rectangular except with a curved front edge 44 and thus typically two curved front corners 46, while the two back corners 48 are generally squared (with "front" being closer to the mouth of the baby using the pacifier 12). And the depicted tab retaining head 34 is generally rectangular except with a curved front edge 50 and thus typically two curved front corners 52, while the two back corners 54 are generally squared. An advantage of this arrangement is illustrated by the following description of the use of the device 10.

FIGS. 11-18 show how the pacifier 12 and the toy 14 can be easily coupled and decoupled by the transverse motion. To couple them together, first one squared corner 54 of the tab retaining head 34 is transversely inserted into one of the squared corners 48 of the pacifier slot 32 (see FIG. 11), then the other (see FIG. 12). When the second squared corner 54 of the tab retaining head 34 is transversely inserted into the pacifier slot 32, the retaining head deforms into a smaller profile and/or the slot deforms into a larger profile by the force of their contacting engagement. So both squared corners 54 of the tab retaining head 34 are now transversely inserted into and through the slot 32 adjacent (below) the slot squared corners 48, but the opposing curved corners 52 of the tab retaining head 34 are not (see FIGS. 13-14). Then the tab retaining head 34 is pivoted (see FIG. 15) to engage the slot 32 (i.e., its inner surface) and thereby deform and swing its curved corners 52 past the deforming slot curved corners 46 and through the slot, until the retaining head and slot resiliently return to their neutral/undeformed states and the detachable coupling 16 is in the attached position for use (see FIG. 16). In this attached or coupled position, facing surfaces 35 and 39 of the tab retaining head 34 and the tab extension arm 38 are generally parallel, facing each other, and on opposite sides of the slot extension arm 40. As can be see, the transverse motion/force need not be solely in a transverse direction, rather the motion/force can be pivotal/angular with a transverse component and an axial component. To detach the toy 14 from the pacifier 12, the toy retaining head 34 is pivoted back (see FIG. 17) and then transversely pulled (see FIG. 18) from the slot 32.

The detachment coupling 16 components can be made of conventional materials such as silicone, polypropylene (PP), ethylene vinyl acetate (EVA), acrylonitrile butadiene styrene (ABS), and/or thermo-plastic rubber (TPR), they can be translucent, transparent with color, or opaque, and they can be formed with a durometer of for example about 30 to about 85 Shore A. In particular, in some embodiments the tab extension arm 38 is less than 1¼ inches, and in such embodiments (e.g., with the tab extension arm 38 about 1 inch to about 1⅛ inches) it is made of a material with a durometer of about 5 to about 70 Shore A, for example about 50 to about 55 Shore A. For smaller parts, the lower durometer (and thus softer material) help prevent them from becoming a possible a choking hazard (in the event they became separated and loose) and conform to certain U.S. and European safety standards.

In some embodiments, the tab 30 and the tab extension arm 38 are made of a material with a durometer of about 5 to about 70 Shore A, preferably about 60 Shore A, and the slot extension arm 40 is made of a material with a durometer of about 5 to about 70 Shore A, preferably about 40 Shore A, to result in a detachable coupling 16 with a net axial pull-away force (on the pacifier 12 and/or the toy 14 to separate them) being about 0.1 lb to about 10 lbs, preferably about 3 lbs. to about 5 lbs., and with net transverse insertion and separation forces on the pacifier and/or the toy to attach and detach them being less than that. In this arrangement, the toy 14 can be easily separated by a caregiver with the dexterity and hand strength to manipulate the tab 30 transversely relative to the slot 32, but cannot by an infant who will generally only pull on the toy applying axial forces too small to decouple the components.

In addition, the components of the detachment coupling 16, primarily the tab and slot extension arms 38 and 40, can be made of a material and/or have a structural design so that the axis of the toy body 24 does not droop and angle relative to the axis of the pacifier nipple 20 by a significant degree. In typical embodiments, for example, the tab and slot extension arms 38 and 40 are designed so that the axis of the toy body 24 does not droop and angle relative to the axis of the pacifier nipple 20 by more than about 30 degrees.

A plurality of the pacifiers 12 and/or the toys 14 can be packaged together or individually for use together. Because the couplings 16 are universal, when one toy 14 (for example in the form of a cow) has been detached from the pacifier 12 and is being laundered, a different toy (for example in the form of a frog) can be attached to the pacifier for continued use. Or the separated pacifiers 12 and/or the toys 14 can be used independently when desired and then coupled together for joint use when desired. In other embodiments, the toy portion of the coupling is adapted for detachably connecting to standard pacifiers (i.e., without the pacifier portion of the coupling).

The combined pacifier-toy device 10 provides a number of additional benefits. The weight of the toy 14 helps keep the pacifier 12 in the baby's mouth. The toy 14 provides an entertainment feature for a baby sucking on the pacifier 12. The combined pacifier-toy device 10 is easier to find in a diaper bag. And the pacifier 12 can be removed when the child is older to facilitate breaking the attachment to the pacifier by allowing the child to continue playing with the detached toy 14 by itself.

In some embodiments the device includes a safety feature to ensure that the transverse tab does not detach from the toy and present a choking hazard. This safety feature can be included in any type of combination pacifier-toy device in which the toy detaches from the pacifier. Thus, in some embodiments this safety feature is included in pacifier-toy devices including a toy coupling portion that is attached to the toy but not one with a transverse tab or slot.

Referring particularly to FIGS. 19-22, this safety feature includes a redundant retaining element 56 that attaches the transverse tab 30 to its component (the toy 14 in this embodiment). That is, the retaining element 56 is a secondary or back-up feature to the primary attachment 42, which is designed to be robust and withstand any forces it might be subjected to but nevertheless could conceivably fail upon mistreatment or abuse of the device 10. In the depicted embodiment, the secondary retaining element is a tether (e.g., a strap or cord) 56 attached between the tab extension arm 38 and the shell 28 of the toy head 26 inside the shell (note that in FIGS. 20-21 the toy head is turned inside out). The tether 56 can be attached to the tab extension arm 38 and the shell 28 by attachments 58 and 60, respectively, such as stitching or other conventional fasteners. The tether 56 can be attached to the shell 28 at its two ends 62 and attached to the tab extension arm 38 at an intermediate portion 64 (as depicted) to effectively provide two tethers, it can attach to the shell and extension arm at its two ends, or additional ethers can be provided.

Typically, the tether 56 includes some extra length or slack, that is, the length of the tether between attachment points is greater than the distance between the attachments. In this way, the attachments 58 and 60, as well as the tether 56 itself, are not subjected to detachment forces when the baby pulls the toy 14 axially away from the pacifier 12, as babies tend to do. So the tether 56 and the attachments 58 and 60 do not assist in withstanding detachment forces during the normal lifetime use of the device 10, and instead the primary attachment 42 bears the full load. This helps ensure the structural integrity of the tether 56 so it is intact and ready for use if needed. In the unlikely event that the primary attachment 42 fails, pulling axially on the toy 14 while holding the pacifier 12 will cause the tab extension arm 38 to slide forward relative to the toy head 26 until the extra length or slack in the tether 56 is taken up and the tether is tensioned now bearing the full load of the axial detachment forces to retain the extension arm from further axial movement and from separation from the toy.

In addition, this arrangement provides for a visual indication to caregivers in the unlikely event that the primary attachment 42 fails. This is because the extra length or slack in the tether 56 permits the tab extension arm 38 to slide forward relative to the toy head 26 (see FIG. 22) when the toy 14 is pulled away from the pacifier 12 (as indicated by the directional arrow) and the primary attachment 42 fails, and this additional exposed length of the extension arm is readily noticeable to caregivers. The tether 56 is now engaged and retains the tab extension arm 38 to the toy 14, but the device 10 (or at least the toy 14) should now be replaced for safety reasons.

FIGS. 23-26 show a functionally similar safety feature of a combination pacifier-toy device according to a second example embodiment of the invention. In this embodiment, the redundant retaining element that attaches the transverse tab 130 to its component (the toy 114 in this embodiment) is at least one wing 156 extending laterally from the tab extension arm 138 inside the shell 128 (note that in FIG. 25 the toy head is turned inside out). Two wings 156 can be providing extending oppositely away from each other on opposite sides of the tab extension arm 138 (as depicted), or only one wing or more than two wings can be provided if desired. The wings 156 have a lateral dimension 166 that is greater than a lateral dimension 168 of the opening 170 in the shell 128 through which the tab extension arm 138 extends. As such, the wigs 156 cannot pass through the opening 170 and instead abut against the shell 128 adjacent the opening.

Typically, the tab extension arm 138 includes some extra length, that is, the extension arm includes a medial portion 172 between the primary attachment 142 and the wings 156 so that the wings are not adjacent the primary attachment and the shell 128 during normal use, and instead are positioned farther inside the shell 128. In this way, the wings 156 and the shell 128 adjacent the opening 170 are not subjected to detachment forces when the baby pulls the toy 114 axially away from the pacifier (not shown), as babies tend to do. So the wings 156 and the shell 128 adjacent the opening 170 do not assist in withstanding detachment forces during the normal lifetime use of the device 110, and instead the primary attachment 142 bears the full load. This helps ensure the structural integrity of the wings 156 and the shell 128 adjacent the opening 170 so they are intact and ready for use if needed. In the unlikely event that the primary attachment 142 fails, pulling axially on the toy 114 while holding the pacifier 112 will cause the tab extension arm 138 to slide forward relative to the toy head by the extra length of the tab extension arm until the wings 156 abut the shell 128 adjacent the opening 170 to now bear the full load of the axial detachment forces and retain the extension arm from further axial movement and from separation from the toy.

In addition, this arrangement provides for a visual indication to caregivers in the unlikely event that the primary attachment 142 fails. This is because the extra length provided by the medial portion 172 permits the tab extension arm 138 to slide forward relative to the toy head 126 (see FIG. 26) when the toy 114 is pulled away from the pacifier (as indicated by the directional arrow) and the primary attachment 142 fails, and this additional exposed length of the extension arm is readily noticeable to caregivers. The wings 156 now abut the shell 128 adjacent the opening 170 and retain the extension arm from sliding farther and out of the shell, but the device (or at least the toy 114) should now be replaced for safety reasons.

In other embodiments, the secondary retaining element is provided by another element that provides the same functionality of redundancy in retaining a portion of the coupling from separating from the toy. For example, the secondary retaining element can be in the form of a spring-biased retainer that deploys laterally outward upon failure of the primary attachment, a retainer mounted to the shell that engages an element of the extension arm, or another conventional retaining element known in the art that extends from or is mounted to the extension arm to be retained. It will be appreciated that the secondary retaining element need not fixedly attach the extension arm in a certain position relative to the toy (as the primary attachment does), it need only prevent separation of the extension arm from the toy.

Figure 27:
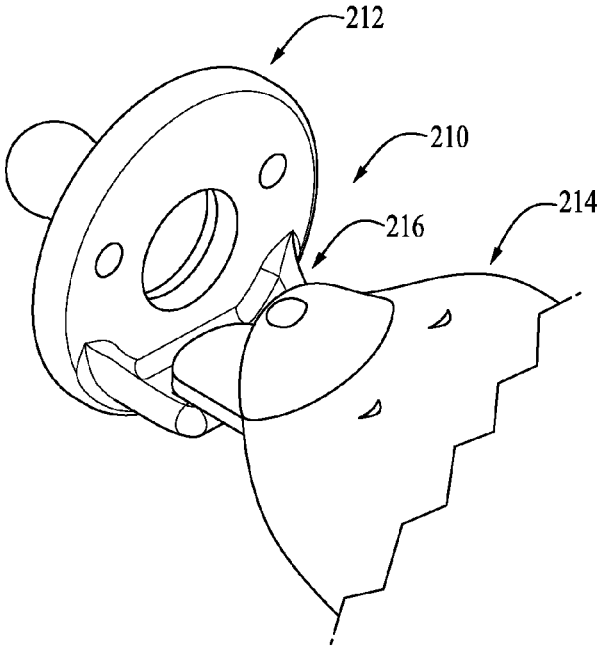
FIG. 27 is a top perspective view of a portion of a combination pacifier-toy device according to a third example embodiment of the present invention.
Figure 28:
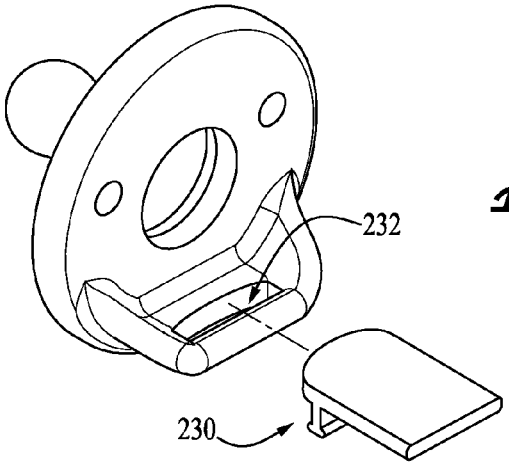
FIG. 28 shows the pacifier and toy of FIG. 27 detached from each other.

FIGS. 27-28 show a combination pacifier-toy device 210 according to a third example embodiment of the invention. This device 210 is similar to the embodiment described above in that it includes a pacifier 212, a toy 214, and a coupling 216 that removably attaches them together, with the coupling including a transverse tab 230 and a transverse opening 232 that couple and decouple by a transverse motion.

Figure 29:
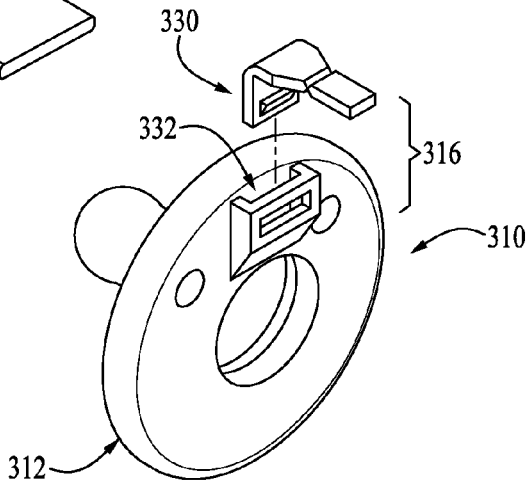
FIG. 29 is a perspective view of a portion of a combination pacifier-toy device according to a fourth example embodiment of the present invention.
Figure 30:
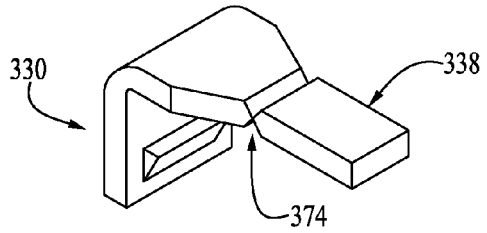
FIG. 30 shows a portion of the toy coupling portion of FIG. 29.

FIGS. 29-30 show a combination pacifier-toy device 310 according to a fourth example embodiment of the invention. This device 310 is similar to the embodiments described above in that it includes a pacifier 312, a toy (not shown), and a coupling 316 that removably attaches them together, with the coupling including a transverse tab 330 and a transverse opening 332 that couple and decouple by a transverse motion. In addition, this embodiment include a living hinge 374 in the tab extension arm 338 that permits the toy to more freely droop to angular positions when the pacifier is held in the infant's mouth.

Figure 31:
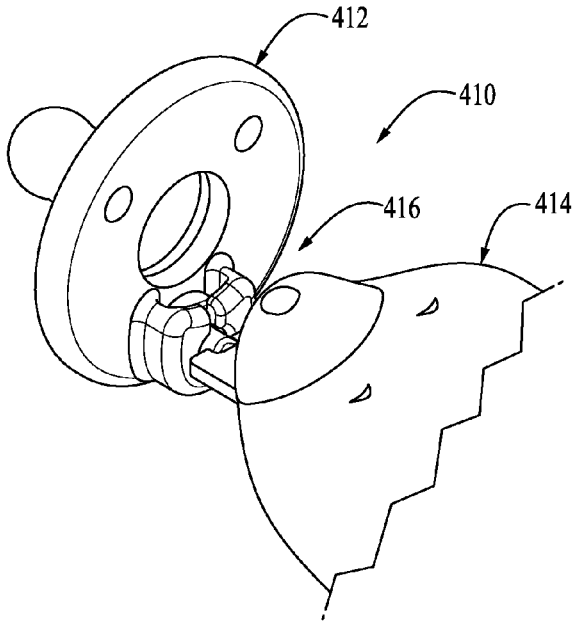
FIG. 31 is a top perspective view of a portion of a combination pacifier-toy device according to a fifth example embodiment of the present invention.
Figure 32:
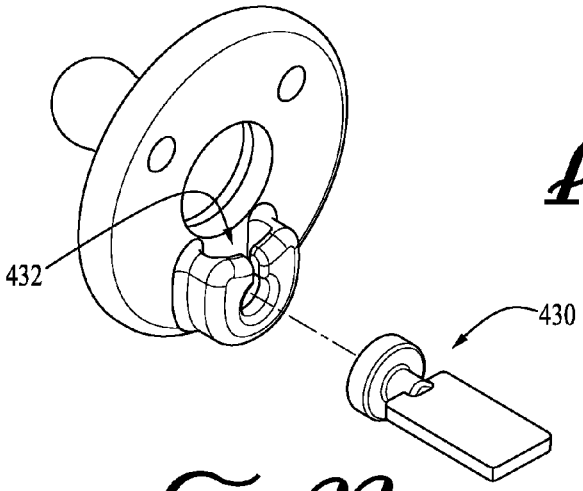
FIG. 32 shows the pacifier and toy of FIG. 31 detached from each other.

FIGS. 31-32 show a combination pacifier-toy device 410 according to a fifth example embodiment of the invention. This device 410 is similar to the embodiments described above in that it includes a pacifier 412, a toy 414, and a coupling 416 that removably attaches them together, with the coupling including a transverse tab 430 and a transverse opening 432 that couple and decouple by a transverse motion.

Figure 33:
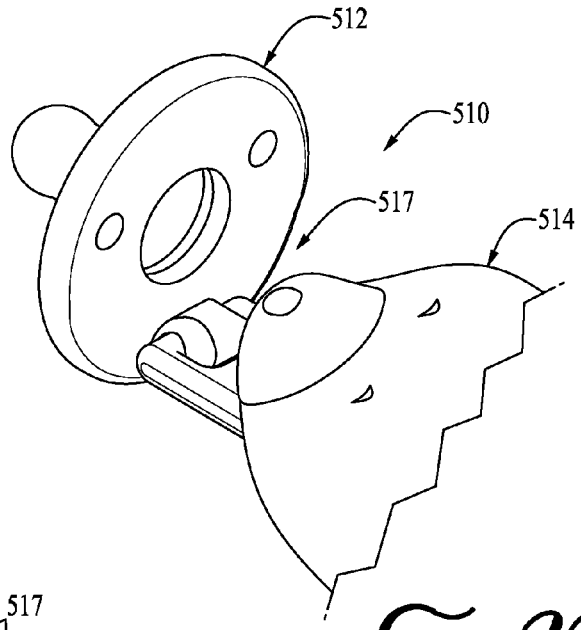
FIG. 33 is a top perspective view of a portion of a combination pacifier-toy device according to a sixth example embodiment of the present invention.
Figure 34:
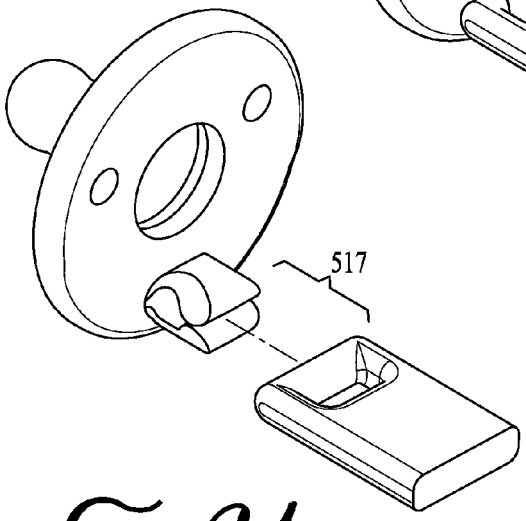
FIG. 34 shows the pacifier and toy of FIG. 33 detached from each other.

FIGS. 33-34 show a combination pacifier-toy device 510 according to a sixth example embodiment of the invention. This device 510 is similar to the embodiments described above in that it includes a pacifier 512, a toy 514, and a coupling 517 that removably attaches them together, but in this embodiment the coupling includes components that couple and decouple by an axial motion.

Figure 35:
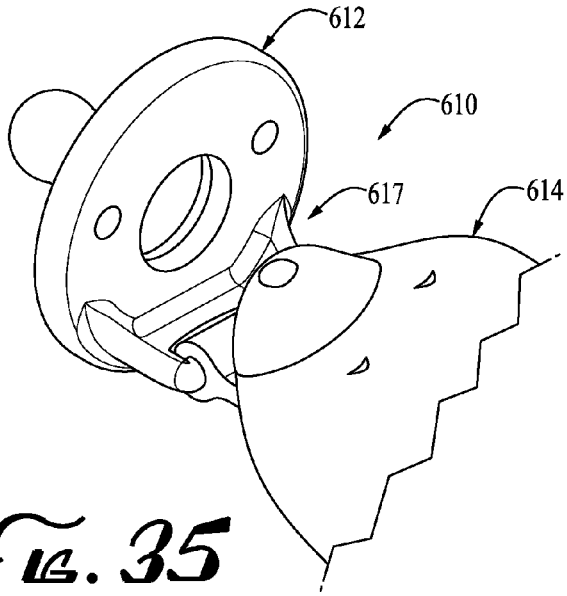
FIG. 35 is a top perspective view of a portion of a combination pacifier-toy device according to a seventh example embodiment of the present invention.
Figure 36:
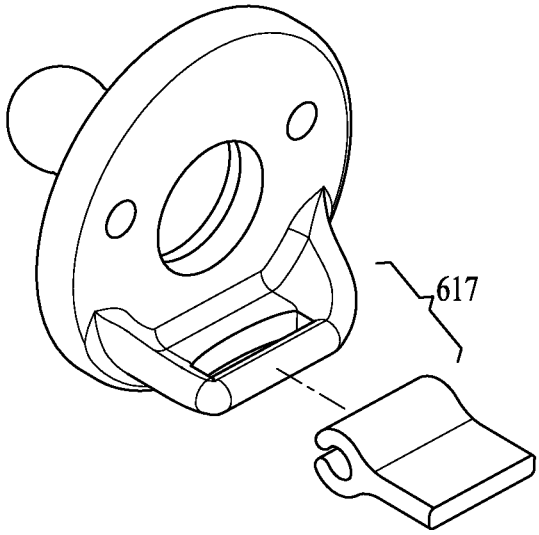
FIG. 36 shows the pacifier and toy of FIG. 35 detached from each other.

FIGS. 35-36 show a combination pacifier-toy device 610 according to a seventh example embodiment of the invention. This device 610 is similar to the embodiments described above in that it includes a pacifier 612, a toy 614, and a coupling 617 that removably attaches them together, but in this embodiment the coupling includes components that couple and decouple by an axial motion.

Figure 37:
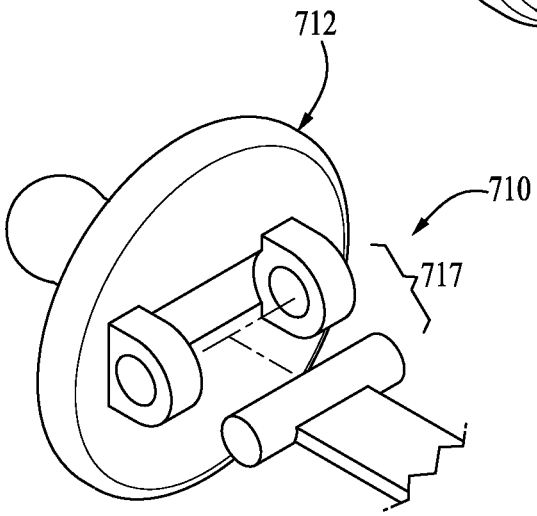
FIG. 37 is a top perspective view of a portion of a combination pacifier-toy device according to an eighth example embodiment of the present invention, with the pacifier and toy detached from each other.
Figure 38:
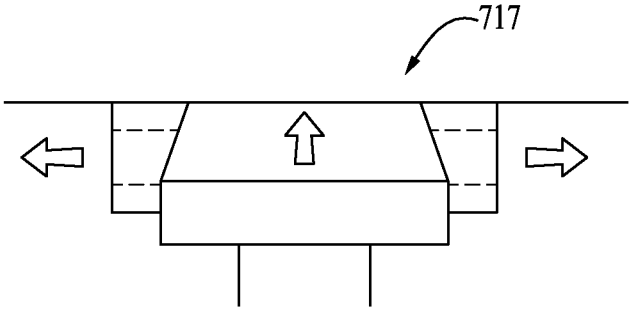
FIG. 38 is a top view of the pacifier and toy of FIG. 37 being attached together.

FIGS. 37-38 show a combination pacifier-toy device 710 according to an eighth example embodiment of the invention. This device 710 is similar to the embodiments described above in that it includes a pacifier 712, a toy (not shown), and a coupling 717 that removably attaches them together, but in this embodiment the coupling includes components that couple and decouple by an axial motion.

Figure 39:
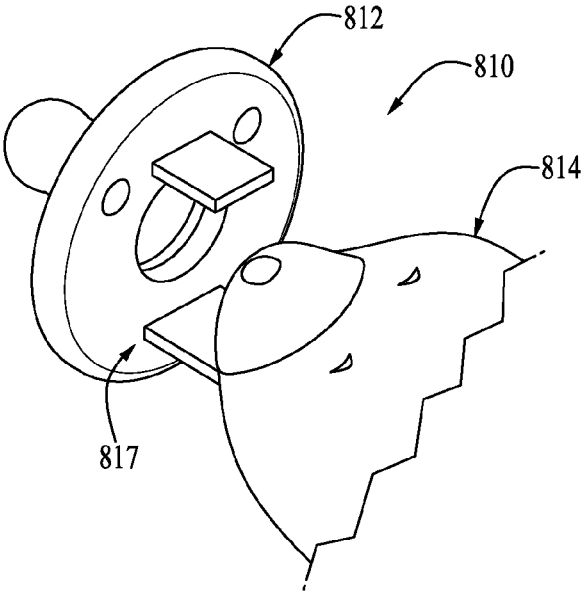
FIG. 39 is a top perspective view of a portion of a combination pacifier-toy device according to a ninth example embodiment of the present invention.
Figure 40:
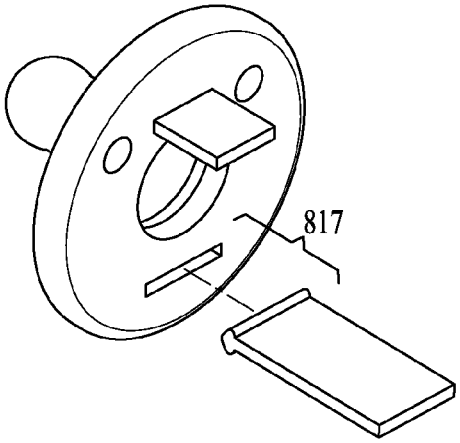
FIG. 40 shows the pacifier and toy of FIG. 39 detached from each other.

FIGS. 39-40 show a combination pacifier-toy device 810 according to a ninth example embodiment of the invention. This device 810 is similar to the embodiments described above in that it includes a pacifier 812, a toy 814, and a coupling 817 that removably attaches them together, but in this embodiment the coupling includes components that couple and decouple by an axial motion.

Figure 41:
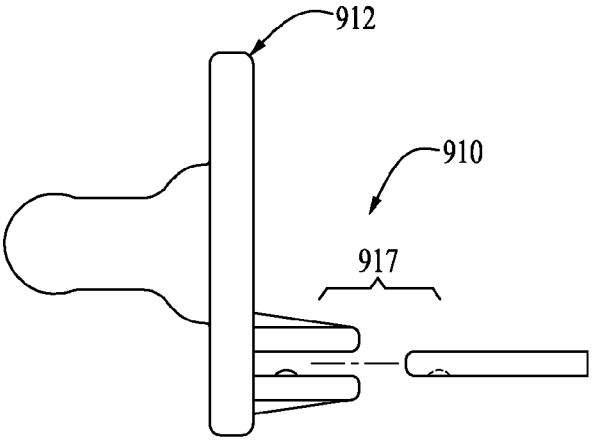
FIG. 41 is a side view of a portion of a combination pacifier-toy device according to a tenth example embodiment of the present invention, with the pacifier and toy detached from each other.
Figure 42:
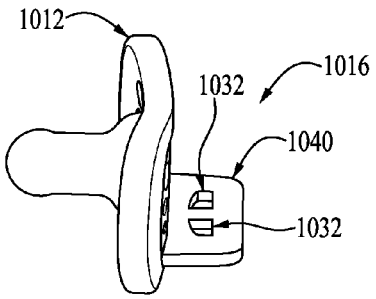
FIG. 42 is a perspective view of a pacifier portion of a combination pacifier-toy device according to an eleventh example embodiment of the invention.
Figure 43:
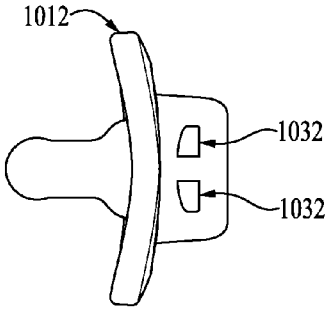
FIG. 43 is a top view of the pacifier portion of FIG. 42.
Figure 44:
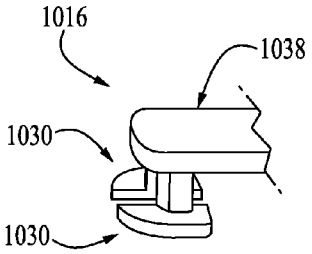
FIG. 44 is a perspective view of a toy portion of the combination pacifier-toy device of FIG. 42.
Figure 45:
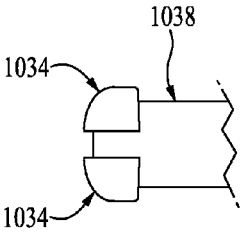
FIG. 45 is a bottom view of the toy portion of FIG. 44.
Figure 46:
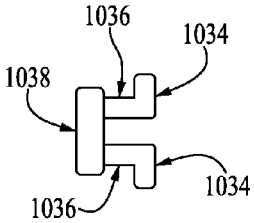
FIG. 46 is an end view of the toy portion of FIG. 45.
Figure 47:
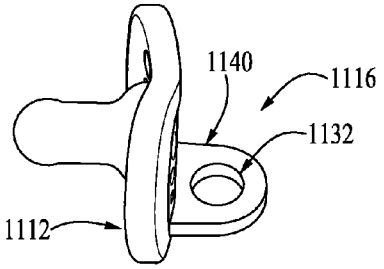
FIG. 47 is a perspective view of a pacifier portion of a combination pacifier-toy device according to a twelfth example embodiment of the invention.
Figure 48:
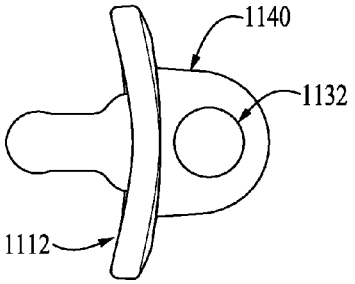
FIG. 48 is a top view of the pacifier portion of FIG. 47.
Figure 49:
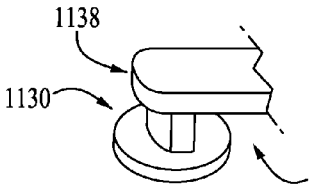
FIG. 49 is a perspective view of a toy portion of the combination pacifier-toy device of FIG. 47.
Figure 50:
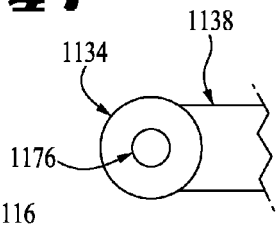
FIG. 50 is a bottom view of the toy portion of FIG. 49.
Figure 51:
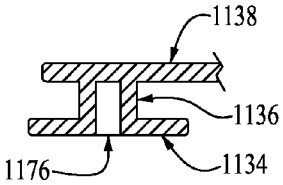
FIG. 51 is a side view of the toy portion of FIG. 45.

FIG. 41 shows a combination pacifier-toy device 910 according to a tenth example embodiment of the invention. This device 910 is similar to the embodiments described above in that it includes a pacifier 912, a toy (not shown), and a coupling 917 that removably attaches them together, but in this embodiment the coupling includes components that couple and decouple by an axial motion.

FIGS. 42-46 show a portion of a combination pacifier-toy device according to an eleventh example embodiment of the invention. This device is similar to the first through sixth embodiments described above in that it includes a pacifier 1012, a toy (not shown), and a coupling 1016 that removably attaches them together, with the coupling including a transverse tab 1030 and a transverse opening 1032 that couple and decouple by a transverse motion. In this embodiment, there are two transverse tabs 1030 (each including a connecting arm 1036 with a retaining head 1036) extending transversely from the tab extension arm 1038, and two transverse openings 1032 formed transversely through the opening extension arm 1040. The connecting arms 1036, retaining heads 1036, and openings 1032 can be formed in a number of different shapes, for example quadrant (as depicted) or another regular or irregular shape.

FIGS. 47-51 show a portion of a combination pacifier-toy device according to a twelfth example embodiment of the invention. This device is similar to the first through sixth and eleventh embodiments described above in that it includes a pacifier 1112, a toy (not shown), and a coupling 1116 that removably attaches them together, with the coupling including a transverse tab 1130 and a transverse opening 1132 that couple and decouple by a transverse motion. In this embodiment, the connecting arm 1136 and the retaining head 1136 of the transverse tab 1130 (extending transversely from the tab extension arm 1138) have a circular cross-sectional shape, as does the transverse opening 1132 formed transversely through the opening extension arm 1140. In addition, the connecting arm 1136 and the retaining head 1136 of the transverse tab 1130 have a bore 1076 recessed therein such that an internal portion thereof is hollow and thus compressible (radial inward) to resiliently deform during insertion and withdrawal relative to the transverse opening 1132. The connecting arms 1136, retaining heads 1136, bores 1176, and openings 1132 can be formed in a number of different shapes, for example circular (as depicted) or another regular or irregular shape.

FIGS. 52-53 show a portion of a combination pacifier-toy device according to a thirteenth example embodiment of the invention. This device is similar to the first through sixth and eleventh through twelfth embodiments described above in that it includes a pacifier (not shown), a toy (not shown), and a coupling 1216 that removably attaches them together, with the coupling including a transverse tab 1230 and a transverse opening 1232 that couple and decouple by a transverse motion. In this embodiment, the connecting arm 1236, retaining head 1236, and opening 1232 are elliptical in shape.

FIGS. 54-55 show a portion of a combination pacifier-toy device according to a fourteenth example embodiment of the invention. This device is similar to the first through sixth and eleventh through thirteenth embodiments described above in that it includes a pacifier (not shown), a toy (not shown), and a coupling 1316 that removably attaches them together, with the coupling including a transverse tab 1330 and a transverse opening 1332 that couple and decouple by a transverse motion. In this embodiment, the connecting arm 1336, retaining head 1336, and opening 1332 are hexagonal in shape.

FIGS. 56-57 show a portion of a combination pacifier-toy device according to a fifteenth example embodiment of the invention. This device is similar to the first through sixth and eleventh through fourteenth embodiments described above in that it includes a pacifier (not shown), a toy (not shown), and a coupling 1416 that removably attaches them together, with the coupling including a transverse tab 1430 and a transverse opening 1432 that couple and decouple by a transverse motion. In this embodiment, the connecting arm 1436, retaining head 1436, and opening 1432 are triangular in shape.

While the invention has been described with reference to preferred and example embodiments, it will be understood by those skilled in the art that a variety of modifications, additions and deletions are within the scope of the invention, as defined by the following claims.

What is claimed is:

1. An infant-comfort device, comprising:

a soothing device having a longitudinal axis;

a toy; and a coupling that detachably connects the toy to the soothing device, wherein the coupling includes a tab that extends transverse to the soothing device longitudinal axis and a slot that extends transverse to the soothing device longitudinal axis and receives the transverse tab in a coupled position, and wherein the tab extends from one of the toy and the soothing device and the slot is formed in the other one of the toy and the soothing device, wherein the tab includes a retaining head and a transverse connecting arm from which the head extends, the coupling further includes a tab extension arm from which the tab connecting arm extends and a slot extension arm in which the slot is formed, the tab retaining head is larger than the slot, the tab retaining head and the slot extension arm are made of a resiliently deformable material, wherein the transverse tab inserts through and withdraws from the transverse slot by a transverse motion to couple and decouple the toy and the soothing device.

2. The device of claim 1, wherein the soothing device is a pacifier including a nipple extending along the longitudinal axis and a flange from which the nipple extends.

3. The device of claim 1, wherein the toy is a plush animal character.

4. The device of claim 1, wherein the retaining head is generally rectangular with two squared corners except for a curved front edge and two front rounded corners, and wherein the slot is generally rectangular with two squared corners except for a curved front edge and two front rounded corners.

5. The device of claim 4, wherein the toy attaches to the soothing device by transversely inserting one of the head squared corners into the slot adjacent one of the slot squared corners, then transversely inserting the other one of the head squared corners into the slot adjacent the other one of the slot squared corners, and then pivoting the retaining head until the two head rounded corners are transversely inserted through the slot past the two slot rounded corners.

6. The device of claim 1, wherein the tab extension arm has a length of less than 1¼ inches and has a durometer of about 5 Shore A to about 70 Shore A.

7. The device of claim 1, wherein the tab and the tab extension arm have a durometer of about 5 Shore A to about 70 Shore A, the slot extension arm has a durometer of about 5 Shore A to about 70 Shore A, and a net pull-away force required to axially separate the toy from the soothing device is about 0.1 lbs. to about 10.0 lbs.

8. The device of claim 1, wherein a net pull-away force applied to the toy, the soothing device, or both, required to axially separate the toy from the soothing device is greater than a net transverse force applied to the tab, the slot extension arm, or both, required to transversely separate the toy from the soothing device.

9. The device of claim 1, wherein the slot extension arm extends axially from a back side of the soothing device and is parallel to but offset from the longitudinal axis of the soothing device.

10. The device of claim 1, wherein the coupling is adapted so that in use a longitudinal axis of the toy does not drop down relative to the longitudinal axis of the soothing device by more than about 30 degrees.

11. The device of claim 1, wherein the coupling includes an extension arm that extends from the toy and that extends from or defines the tab or the slot, further comprising a primary attachment that fixedly attaches the extension arm to the toy and a secondary retainer that retains the extension arm from separating from the toy if the primary attachment fails.

12. The device of claim 11, wherein in normal use the primary attachment bears all axial detachment forces applied to the toy and the secondary retainer bears none of the axial detachment forces, wherein the secondary retainer includes extra length so that the extension arm will move axially forward under the axial detachment forces until the secondary retainer stops the extension arm from further axially forward movement, and wherein the secondary retainer is a tether attached between the extension arm and the toy or the secondary retainer is a wing extending laterally from the extension arm beyond an opening in the toy through which the extension arm axially extends.

13. An infant-comfort device, comprising:

a pacifier including a nipple with a longitudinal axis and a flange from which the nipple extends;

a toy; and a coupling that detachably connects the toy to the pacifier, wherein the coupling includes a tab that extends transverse to the pacifier longitudinal axis and a slot that extends transverse to the pacifier longitudinal axis and receives the transverse tab in a coupled position, wherein the tab extends from the toy and the slot is formed in the pacifier, wherein the transverse tab inserts through and withdraws from the transverse slot by a transverse motion to couple and decouple the toy and the pacifier, wherein the tab includes a retaining head and a transverse connecting arm from which the retaining head extends, wherein the coupling further includes a tab extension arm from which the tab connecting arm extends and a slot extension arm in which the slot is formed, wherein the tab retaining head is larger than the slot, wherein the tab retaining head and the slot extension arm are made of a resiliently deformable material, wherein a net pull-away force applied to the toy, the pacifier, or both, required to axially separate the toy from the pacifier is greater than a net transverse force applied to the tab, the slot extension arm, or both, required to transversely separate the toy from the pacifier.

14. The device of claim 13, wherein the toy is a plush animal character having a body and a head.

15. The device of claim 13, wherein the retaining head is generally rectangular with two squared corners except for a curved front edge and two front rounded corners, and wherein the slot is generally rectangular with two squared corners except for a curved front edge and two front rounded corners.

16. The device of claim 15, wherein the toy attaches to the soothing device by transversely inserting one of the head squared corners into the slot adjacent one of the slot squared corners, then transversely inserting the other one of the head squared corners into the slot adjacent the other one of the slot squared corners, and then pivoting the head until the two head rounded corners are transversely inserted through the slot past the two slot rounded corners.

17. The device of claim 13, wherein the tab extension arm has a length of less than 1¼ inches and has a durometer of about 5 Shore A to about 70 Shore A.

18. The device of claim 13, wherein the tab and the tab extension arm have a durometer of about 5 Shore A to about 70 Shore A, the slot extension arm has a durometer of about 5 Shore A to about 70 Shore A, and a net pull-away force required to axially separate the toy from the soothing device is about 0.1 lbs. to about 10.0 lbs.

* * * * *